United States Patent [19]

Ennis

[11] Patent Number: 4,705,118

[45] Date of Patent: Nov. 10, 1987

[54] HAMMER FOR USE IN A BORE HOLE AND APPARATUS FOR USE THEREWITH

[76] Inventor: Melvyn S. J. Ennis, 19 Wynnland Park, Carnmoney, County Antrim, Northern Ireland

[21] Appl. No.: 803,403

[22] PCT Filed: Mar. 18, 1985

[86] PCT No.: PCT/GB85/00104

§ 371 Date: Nov. 14, 1985

§ 102(e) Date: Nov. 14, 1985

[87] PCT Pub. No.: WO85/04212

PCT Pub. Date: Sep. 26, 1985

[30] Foreign Application Priority Data

Mar. 16, 1984 [GB] United Kingdom ..... 8406957

[51] Int. Cl.[4] ..... E21B 4/02; E21B 4/14

[52] U.S. Cl. ..... 175/65; 175/92; 175/296

[58] Field of Search ..... 175/244, 92, 296, 293, 175/215, 405, 404, 333, 58, 60; 166/178

[56] References Cited

U.S. PATENT DOCUMENTS

| | | | |
|---|---|---|---|
| 2,951,467 | 9/1960 | Morrison | 175/296 |
| 3,621,924 | 11/1971 | Lebourg | 175/58 |
| 3,795,283 | 3/1974 | Oughton | 175/215 |
| 3,871,486 | 3/1975 | Curington et al. | 175/215 X |
| 3,991,834 | 11/1976 | Curington | 175/215 X |
| 4,209,070 | 6/1980 | Sudnishnikov et al. | 175/99 X |
| 4,303,138 | 12/1981 | Bassinger | 175/296 |
| 4,319,646 | 3/1982 | Emonet | 173/111 |
| 4,321,974 | 3/1982 | Klemm | 175/92 |
| 4,580,643 | 4/1986 | Fox et al. | 175/244 |

FOREIGN PATENT DOCUMENTS

| | | |
|---|---|---|
| 1133741 | 11/1968 | United Kingdom . |
| 2117428 | 10/1983 | United Kingdom . |

*Primary Examiner*—Stephen J. Novosad
*Assistant Examiner*—Thuy M. Bui
*Attorney, Agent, or Firm*—Saidman, Sterne, Kessler & Goldstein

[57] ABSTRACT

Apparatus for drilling a bore hole comprising a hammer and a dual walled drill tube. The hammer comprises a reciprocable piston, fluid flow control device for directing fluid under pressure to the hammer to reciprocally drive the piston, and cutting device coupled to the hammer which rotate upon reciprocation of the hammer to cut the bore hole. Rachets are coupled to the cutting device to permit rotation of the cutting means in one direction only and to prevent rotation in an opposite direction. A portion of the fluid under pressure is diverted to entrain and direct particulate material to the surface of the bore hole.

18 Claims, 6 Drawing Figures

6
82
81
83
1
FROM
COMPRESSOR
82
2
80
54
37
55
2
3
27

HAMMER FOR USE IN A BORE HOLE AND APPARATUS FOR USE THEREWITH

BACKGROUND OF THE INVENTION

This invention relates to an improved particle sampling apparatus and hammer drill for use in efficiently drilling a bore hole while continuously taking core samples.

The object of the invention is to drill a hole without the use of a conventional drilling rig and to provide a continuous flow of broken particulate material to the surface.

SUMMARY OF THE INVENTION

In accordance with the present invention, apparatus for drilling a bore hole comprises a hammer and a series of dual wall drill tubes, the hammer being supplied with compressed air and being for use in applying successive percussive blows to a percussive drill cutting bit for taking core samples from the bottom end of the bore hole while drilling same, first means for indexing rotationally the bit for drilling purposes, said means being operable by a portion of the supply of air, second means to conduct from the bottom end of the bore hole the portion of air used by and exhausted from the percussive cutting bit and having core particles entrained therein, and third means to assist in conveying said exhausted air and core particles to the surface for collection.

Preferably, an upstanding rig is provided at surface level to support the hammer and drill tubes and to transmit push-down or pull-up movement thereto.

Preferably also, the portion of air actuating the first means is the same as that portion of air sequentially causing the hammer to apply the percussive blows.

Preferably further, the third means comprises an annular flushing jet to direct a portion of air upwardly through a sampling tube co-axial with the drill tube and hammer to induce a venturi to assist in conducting core particle entrained exhaust air upwardly. The flow of air through the jet is continuous and uninterrupted while the flow of exhausted air is intermittent and pulsating.

BRIEF DESCRIPTION OF THE DRAWING

An embodiment of the present invention will now be described, by way of example, with reference to the accompanying drawings, in which:

FIG. 3 being an upright continuation of the view shown in FIG. 2;

DESCRIPTION OF THE PREFERRED EMBODIMENT

Figure 1:
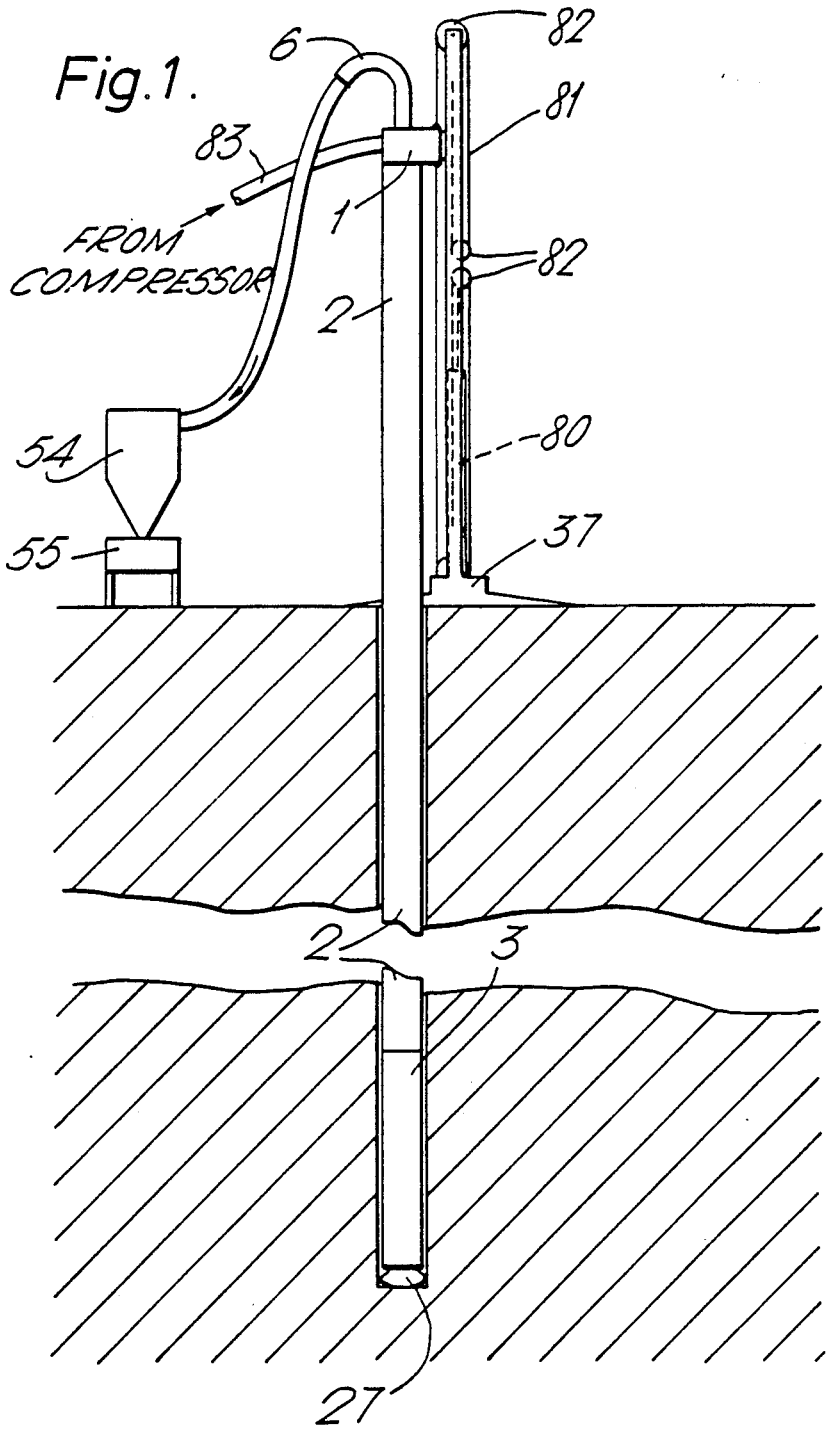
FIG. 1 shows a diagrammatic side elevation of an apparatus according to the present invention for use in drilling bore holes.
Figure 2:
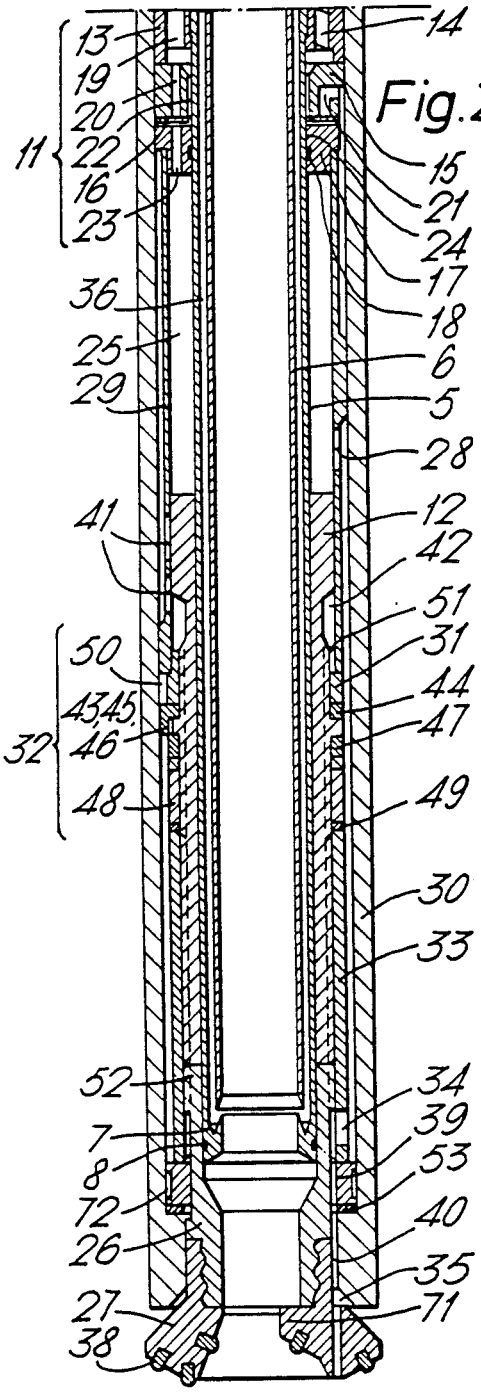
FIGS. 2 and 3 show, to a larger scale than FIG. 1, vertical cross-sectional views of a hammer and drill tubes.
Figure 3:
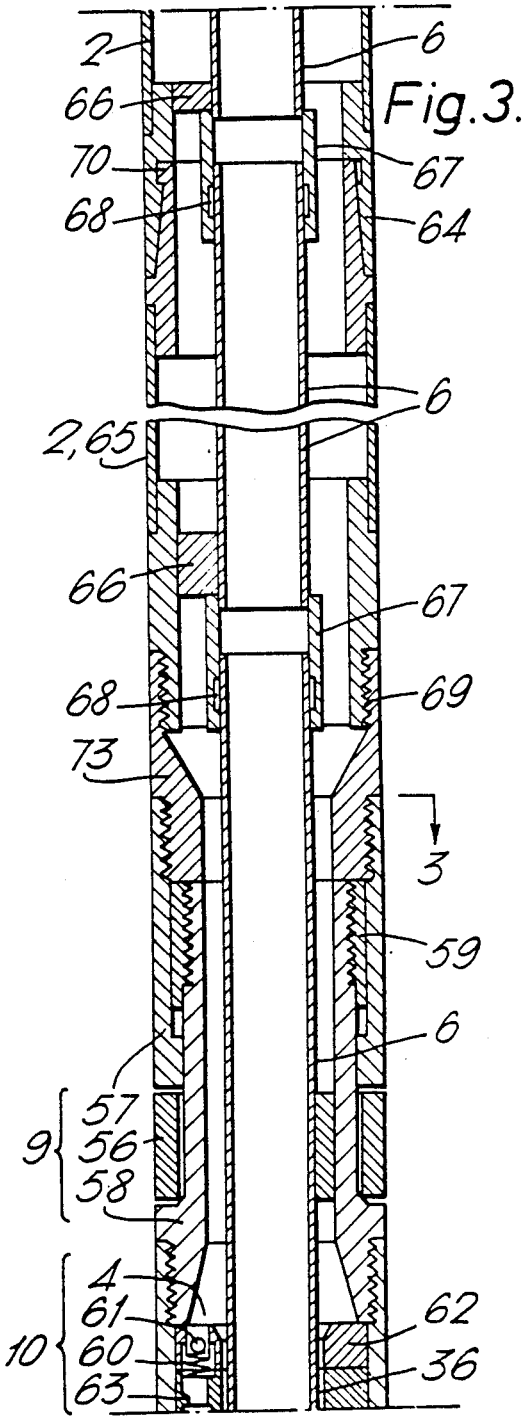

Referring to FIG. 1 of the drawings, the apparatus comprises a rig 37 to be upstanding adjacent to where a bore hole is to be drilled. A drill tube head is carried on said rig 37 to be moved parallely of an upstand thereof by an arrangement of wire ropes 81 entrained around a set of pulleys 82, and the head 1 being moved by operation of extension or retraction of a hydraulically-operable ram 80. The drill head 1 supports a hammer 3 which is of a self-rotating sampling type and as the hammer 3 is progressed into the ground to form a bore hole, dual wall drill tubes 2 are added sequentially according to conventional practice to the hammer 3. The head 1 receives compressed air from a compressor (not shown) via a flexible hose 83. Thus air is fed therefrom to the cutting bit 27 of the hammer 3 to rotate same and drill the bore hole. Details of hammer 3 and the next adjacent drill tube 2 is shown in FIGS. 2 and 3 and will be described hereinunder in relation to the method of operation of the apparatus.

The method comprises the following sequence of events. High pressure compressed air (of the order of 100 psi or above), produced by the surface compressor, is channelled via the flexible hose 83 to the drill tube head 1. The high pressure compressed air then passes down the annular area within the dual wall drill tubes to enter the hammer. After passing through a shock absorber assembly 9, the high pressure compressed air is split at point 4, more than half the high pressure compressed air being directed past the hammer mechanism in the annular area between an inside piston liner 5 and a sample tube 6. This compressed air, which remains at high pressure, is then redirected at a high upward angle into the sample tube 6 by a flushing jet 7, to transport drill hole cuttings to the surface.

The remaining high pressure compressed air at point 4 passes through a water check valve 10 to enter an automatic valve block 11 of the hammer 3. This automatic valve 11 controls motion of a piston 12 of the hammer 3 and comprises six individual parts, i.e. valve cap 13 with air control grommets 14, and automatic valve chest top 15, a flap valve 16, and an automotive valve chest bottom 17 with 'O' ring 18. The air control grommets 14 are fitted to the valve cap 13 to control the amount of air passing into the hammer system. By varying the number of grommets fitted, piston impact performance may be advanced or retarded. As the high pressure air passes through opened portholes 19 of the valve cap 13 and into the automatic valve check block comprising chest top 15, flap valve 16, and chest bottom 17 through an inlet passageway 22 of the chest top 15, the flap valve 16 moves upwards thus closing off outlet portholes 21 provided in the chest top 15. The high pressure compressed air is then channelled through portholes 23 of the automatic valve chest bottom and into a downstroke piston chamber 25. The piston 12 now travels to its maximum downward stroke, thus pushing a bit shank 26 and the cutting bit 27 out to their fully-extending position. The high pressure compressed air in the downstroke piston chamber 25 then exhausts out through exhaust portholes 28 and travels downwards in the annular area between an outside piston liner 29 and a hammer barrel 30. This exhaust air continues past a piston guide bush 31 and a ratchet assembly 32 and down the annular area between a splined drive tube 33 and the barrel 30. Because bit shank 26 and cutting bit 27 are fully-extended thus shutting-off exhaust port-holes 34 of the splined drive tube 33, the high pressure exhaust air is prohibited from escaping out via the exhaust portholes 35, of the cutting bit 27. The air, therefore, becomes trapped in the hammer system. Additional air is prohibited from entering the automatic valve block 11 and so all high pressure compressed air travelling down the dual wall drill string of tubes 2 is directed into a by-pass system 36. The air then passes down to the flushing jet 7 to flush the sample tube clean. Flushing jet 7 is air sealed with drill bit shank 26 by a cheveron type rubber seal 8.

When the sampling hammer 3 and dual wall drill string of tubes 2 are lowered to ground surface, or a bottom of an existing drill hole or whatever, by the rig 37, and the cutting bit 27, containing sintered tungsten carbide cutting teeth 38, comes into contact with resistant material, the cutting bit 27 and attached bit shank 26 are forced to retract inwards into the sampling hammer 3. The high pressure compressed air trapped in the downstroke piston chamber 25 is now allowed to escape through the splined drive tube exhaust portholes 34, past a bit retaining ring 39, a thrust bearing 53, chuck splines 40 and the cutting bit exhaust portholes 35. At the same time as piston 12 is pushed upwards by cutting bit 27 and bit shank 26, inlet portholes on the outside piston liner 41 are opened, and high pressure compressed air is thus allowed to flow into an upstroke piston chamber 42. This sudden reversal of air pressures within the downstroke piston chamber 25 and the upstroke piston chamber 42 causes the flap valve 16 to move downwards and close off the outlet portholes 23 in the automative valve chest bottom 17. High pressure compressed air then passes through the outlet portholes 21 in the automatic valve chest top 15.

Figure 4:
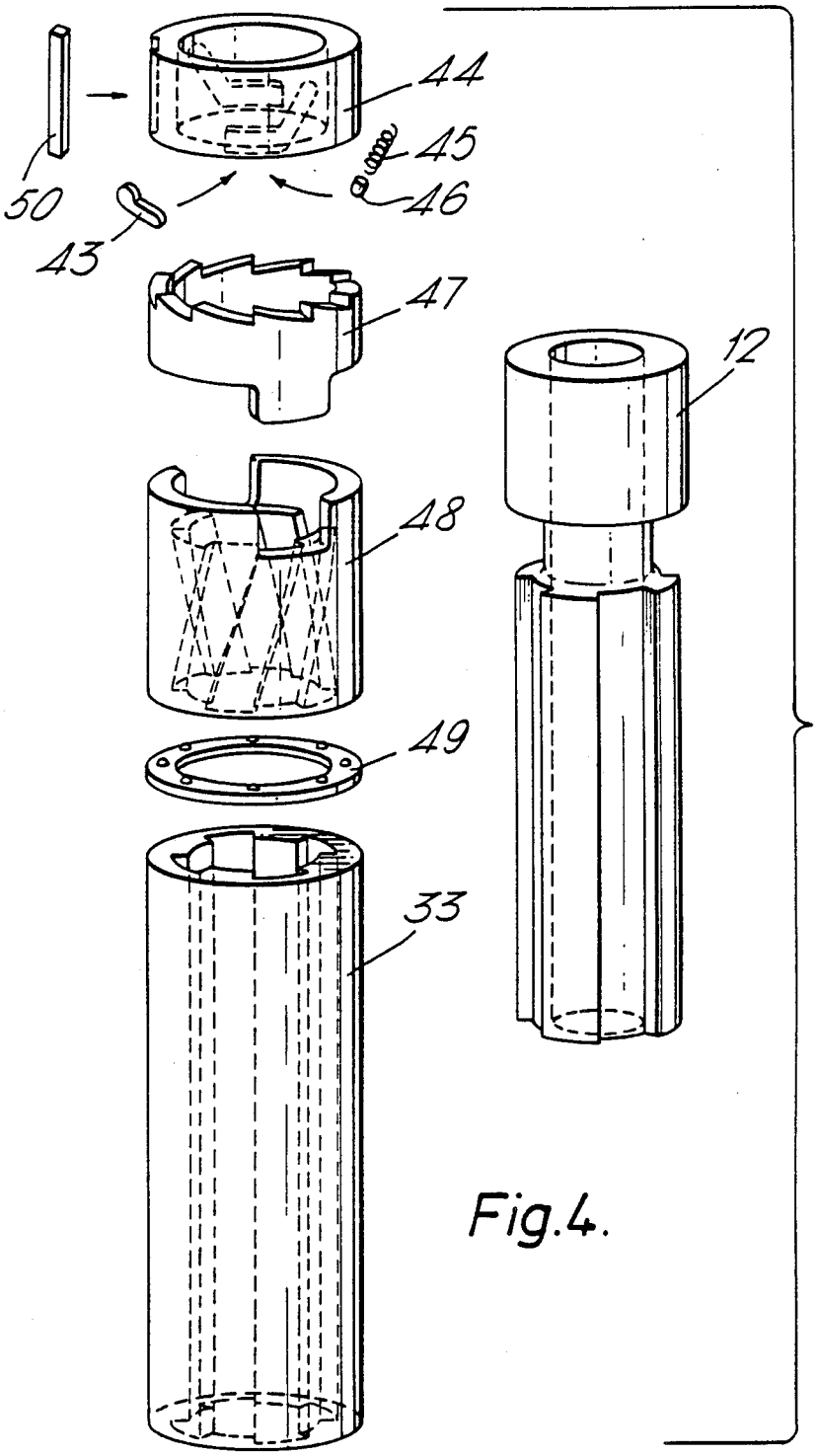
FIG. 4 is an exploded view of a ratchet mechanism to a still larger scale.

As the high pressure compressed air flows into the upstroke piston chamber 42, the piston 12 is forced to move upwards. In so doing, the ratchet mechanism 32 (FIG. 4) locks. Pawls 43 which are held in by a pawl cap 44, and which protrudes outwardly vertically by means of a pawl spring 45 and a pawl plunger 46, lock against teeth of a ratchet gear 47. This ratchet gear 47 is in turn locked into an internal spiral bore 48. This internal spiral bore 48 is separated from the splined drive tube 33 by a thrust bearing 49. Both internal spiral bore 48 and splined drive tube 33 can rotate independent of each other. Because the ratchet mechanism 32 is locked, due to a locking key 50 located between a pawl cap 44 and the hammer barrel 30; the internal spiral bore 48 meshing with piston splines 51 causes the piston 12 to partially rotate on the piston's 12 upstroke. This in turn causes the splined drive tube 33 to partially rotate, owing to the piston splines 51 meshing with the splined drive tube 33. This partial rotation is transmitted to the bit shank 26 by way of splines 52 on the bit shank 26. In turn, the cutting bit 27 rotates partially by the same measure. A thrust bearing 53 exists between the retaining ring 39 and chuck splines 40. The bit retaining ring 39 contains needle bearings 72 which run freely against the inside of the hammer barrel 30.

As the piston 12 continues upwards and passes the outside piston linear exhaust portholes 28, the expanding air in the upstroke piston chamber 42 begins to exhaust out via the portholes 28, past piston guide bush 31, ratchet assembly 32, splined drive tube 33. Because bit shank 26 is now retracted, the splined drive tube exhaust portholes 34 are open and the exhaust air which is now at somewhat lower pressure, escapes past the bit retaining ring 39, thrust bearing 53, chuck splines 40 and cutting bit exhaust portholes 35.

As a result of the sudden pressure difference, the flap valve 16 moves back to close off outlet and inlet portholes 21, 20, in the automatic valve chest top 15. Compressed air now travels down the inlet passageway 22 and through the outlet portholes 23 of the automatic valve chest bottom 17. This compressed air begins to fill the downstroke piston chamber 25 and piston 12 begins its downstroke. Pawls 43 within the ratchet assembly 32 allow the ratchet gear 47 to turn, as piston travels downwards. Exhaust portholes 28 are shut off as piston 12 travels downwards to be opened again as piston 12 passes. Piston 12 continues downwards to strike top of bit shank 26, the impact shock being transmitted to the tungsten carbide cutting teeth 38 via bit shank 26 and cutting bit 27. Shock and some residual compressed air trapped in the upstroke piston chamber 42, bounce the piston 12 up slightly to uncover the bottom inlet portholes 41. Simultaneously, flap valve 16 moves down to close off outlet portholes 23 of the automatic valve chest bottom 17 and so opening the inlet and outlet portholes 20, 21 respectively, of the automatic valve chest top 15. The piston 12 then recommences its upward and downward cycle in rapid succession, and on each cycle, causes the cutting bit 27 and attached bit shank 26 to partially rotate, in the same direction. The air volume required for piston 12 movement in both upstroke and downstroke directions are similar. If V1 represents air volume for piston upstroke and V2 represents air volume for piston downstroke, then $$\overline{V1} \wedge \overline{V2}$$

Also, the active surface area for piston 12 downstroke is equal to the piston's downstroke total upper horizontal surface area. If A1 represents piston's active surface area and A2 represents piston's downstroke total upper horizontal surface area, then $$A1 = A2$$

With hammer motion in operation, compressed air from both downstroke and upstroke piston chambers 25, 42 respectively, exhausts out through the cutting bit exhaust portholes 35 at lower air pressure to the flushing air exhausted from the flushing jet 7. Because the high pressure compressed air is jetted at high upward angle into the sample tube 6 by the flushing jet 7, a venturi action is created between bit face surface 27 and the flushing jet 7, sucking in the hammer's lower pressure exhaust air with entrained bore hole cuttings. The high pressure compressed air jetted from the flushing jet 7 is a continuous uninterrupted air flow, while the lower pressure hammer exhaust air is an intermittent and pulsating flow.

The volume of high pressure compressed air jetted from the flushing jet 7 is equal to, or greater than, the hammer's exhaust volume release from the cutting bit exhaust portholes 35. If V3 represents by-pass flushing volume and V4 represents bit exhaust volume, then $$V3 \geqq V4$$

Flushing jet 7 orifice may be increased or decreased by vertical controlled movement of sample tube 6. The air passageway for both piston 12 impact and sample tube 6 flushing are separate and independent.

When a sub-terranean cavity is encountered, or hammer 3 and drill string 2 is pulled back from hole face, or the cutting bit 27 encounters little or no resistance, then the drill shank 26 and cutting bit 27 becomes fully extended, thus closing the splined drive tube exhaust portholes 34. Piston 12 motion will cease and flushing of the sample tube 6, by the flushing jet 7 continues at an accelerated rate due to the hammer's exhaust being redirected to sample tube 6.

The bit shank 26 and cutting bit 27 may be one piece or, alternatively, separate screw-fit parts. When the cutting bit 27 is separate from the bit shank 26, the cutting bit can be replaced without dismantling the hammer. The surface of the cutting bit 27 is set with sintered tungsten carbide cutting teeth 38 in either blade or button form, or in a combination of both. The cutting face of the bit 27 has an inward tapered face with hollow centre, through which pass the bit face drill hole cuttings, en route to sample tube 6. An eccentric breaking tooth 71 prohibits any rock core formation, breaking the core into smaller particle sizes. The broken particles travel up the sample tube 6 unobstructed, and are ejected with the flushing air out through the drill tube head 1. From here, the samples may pass through a flexible pipe to be collected and separated from the flushing air by a sample cyclone 54. The sample may then pass to a sample splitter 55 to be sized and quartered. Fitted to the top of the hammer barrel 30 is a water check valve assembly 10 and/or a shock absorber assembly 9. The shock absorber assembly 9 consists of a block of shock absorbent material 56 located between two halves of the shock absorber case 57, 58. A shock absorber locking nut 59 locks the two halves of shock absorber case together 57,58. Most of the shock resulting from the piston/bit impact will be absorbed by this assembly before being transmitted up along the dual wall drill tube 2. The water check valve prohibits ground water from entering the piston chambers 25, 42 and automatic valve block assembly 11 during stoppages in drilling such as changing dual wall drill tubes 2. It consists of a spring 60, a non-return valve 61, a water check valve top 62 and a water check valve bottom 63. While drilling is in operation, the high pressure compressed air passing through the water check valve assembly 10 causes it to remain open. Whenever the air supply is cut-off, however, the non-return valve 61 is closed by the water check valve spring 60 releasing tension, thus trapping air within the hammer assembly 3. This trapped air prohibits any ground water from creeping upwards into the hammer assembly 3, except sample tube 6.

Drill bit 27 rotation speed is controlled by the internal spiral bore 48. Rotational speed can be altered by fitting a different internal spiral bore, with differently angled splines. For depth, only the rig 37 is required, which raises or lowers the self-rotating sampling hammer 3 and dual wall tubes 2. Only the cutting bit 27, bit shank 26, piston 12, ratchet assembly 32, splined drive tube 33, bit retaining ring 39, and bearings 49,53,72, rotate.

With the above-described apparatus, there is less wear and abrasion to the hammer barrel 30 and dual wall drill tubes 2 than heretofore. Because the sampling hammer assembly 3 is self-rotating, there is no necessity to have a conventional drilling rig at the surface. No drill rig rotation motor is required, and the self-rotating sampling hammer 3 operates with the use of a conventional drilling rig or the rig 37 above-described.

In unstable ground and underwater conditions, sampling may proceed without the need for additional casing as the string of dual wall drill tubes 2 in effect act as casing. Underwater charging of holes with explosive or whatever, may be carried out using the sample tube 6, while equipment remains in hole. Sample tube 6 may also be used for pressure grouting, the sampling hammer 3 and dual wall drill tubes 2 being retracted as the bore hole becomes grouted under pressure.

Special lightweight dual wall drill tubes 2 may be used which utilize snap-on/bayonet type dual wall drill tube couplings 64. The sample tube 6 is held fixed, centrally within an outer drill tube wall 65 by a series of lugs 66. The bottom end of each length of sample tube is belled 67 and contains a rubber seal 68. As each length of dual wall drill tubes 2 is fixed to another, the top end of the sample tube 6 will slide tightly into the belled end 67 of another sample tube 6 with the rubber seal 68 forming an air tight seal. The outer drill tube 65 may be fixed with each other by male/female screw fixtures 69 or, alternatively, using the snap-on/bayonet type drill tube couplings 64 which use a locking device 70 to secure both couplings. If required, a suitable hammer-drill tube adaptor 73 can be fitted to the top of the hammer assembly to allow a chosen design of drill pipe 2 to be used.

Because the sample tube 6 diameter is large compared to diameter of the hole drilled, conventional or other downhole geophysical detection logging systems may be inserted down the sample tube 6 while drill string 2 and hammer system 3 remains in hole. For this purpose, the complete dual wall tubes 2, including sample tubes 6, may be made of durable, ultra-lighweight non-metallic materials, so allowing a wider range of downhole logging systems to be used. The sample tube 6 may also be used for water-well testing while complete drill string equipment remains in hole. This avoids re-entry of hole by drill string if hole is required to be deepened.

Figure 5:
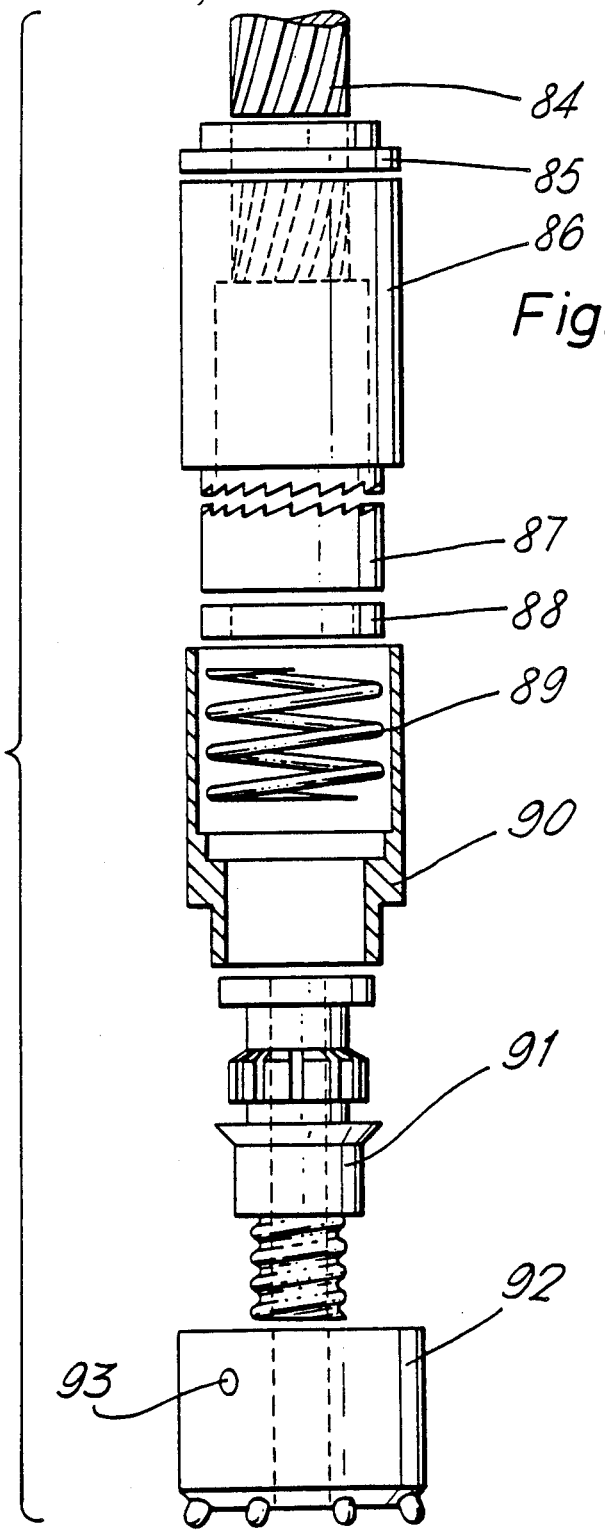
FIG. 5 shows an exploded view of an alternative means of rotation for the cutting bit, the means incorporating a ratchet mechanism.

An alternative means of rotation of the cutting bit to that above-described can be used and this is shown in FIG. 5.

A helix spline on the lower portion of piston 84 causes a splined sleeve 86 containing an internal helix spline at its upper end, to rotate slightly as piston 84 travels downwards to strike a bit shank 91. Teeth on the lower end of the splined sleeve 86 slip against upper teeth of a ratchet 87. As the ratchet 87 is locked with the bit shank 91 by straight interlocking splines, only the splined sleeve 86 is caused to rotate in piston downstroke. The ratchet 87 is allowed to slip and move in the axial plane as it is cushioned by a mechanical spring 89 of variable design. Both the splined sleeve 86 and ratchet 87 are free to rotate being bounded at both ends by thrust bearings 85,88. As the movement of piston 84 reverses to upstroke due to valve poring previously described above and piston 84 begins travelling upwards, the piston's helix splines 84 engage with the internal helix splines of the splined sleeve 86, causing the splined sleeve 86 to rotate in the opposite direction by a small degree. Piston 84 is unable to rotate due to being locked with the outside piston liner 5 which in turn is locked to the rest of the hammer assembly. The drive teeth of the splined sleeve 86 lock with the opposing drive teeth of the ratchet 87. Because both teeth are locked together, there is no compression of spring 89. As the piston 84 continues its upstroke, rotation of the splined drive sleeve 86 takes place. This in turn causes ratchet 87 to rotate and thus the bit shank 91 and bit 27 rotate through the same distance via the ratchet 87 and bit shank 91 interlocking splines. Again bit 27 rotation takes place in between bit 27 impacts. The thrust collar 90 retains the bit shank 91, spring 89 lower thrust bearing 88 and ratchet 87 while locating with and allowing free movement with the splined sleeve 86. While allowing some axial movement of the bit shank 91 and attached bit 27, the thrust collar 90 prohibits bit shank 91 and attached bit 27 from falling out of hammer assembly 3.

The cutting bit 92 shown in FIG. 5 has straight external sides which protect the lower portion of the barrel from abrasion and wear.

An alternative means for locking bit shank 26 with bit 27 can be provided using a self locking mechanism, tapered or socket and pin 93 as shown in FIG. 5.

An independent slidable cradle positioned below the tube head and base of rig 37, positions, holds and aligns the dual wall drill tubes 2, for angle, vertical or horizontal drilling. The rig 37 is capable of vertical, horizontal or angle drilling.

Figure 6:
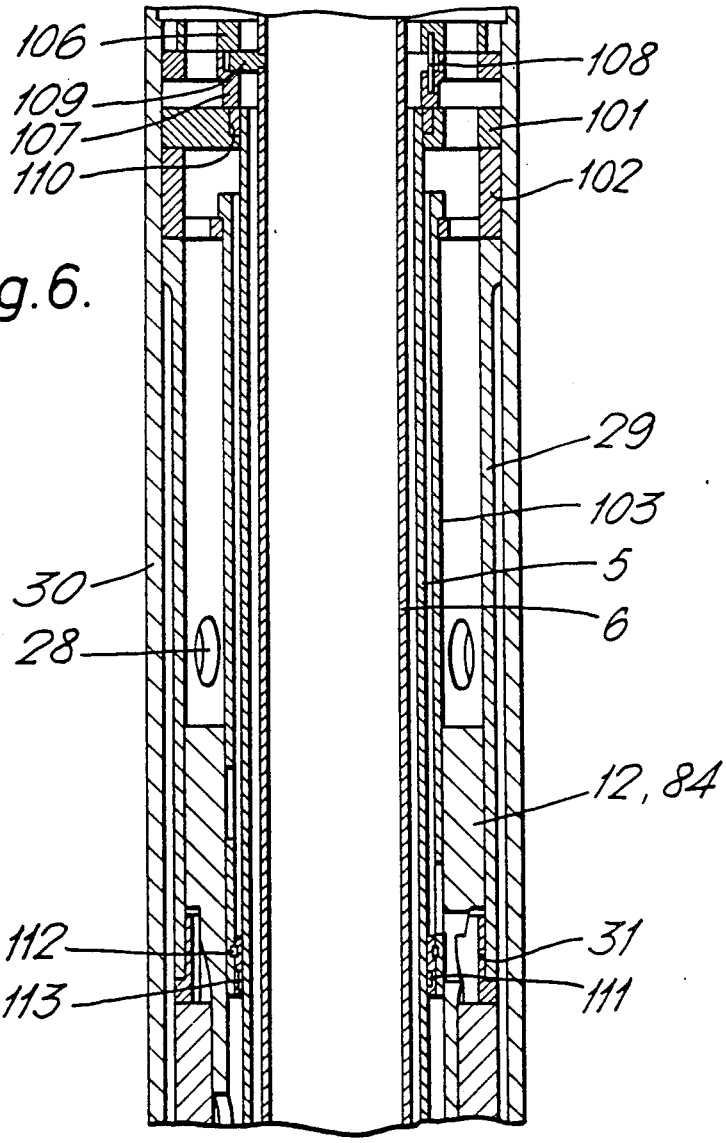
FIG. 6 shows to a different scale a side elevation of alternative means of piston movement.

The above-described embodiment is referred to conventionally as operating with a valve system. The present invention can also operate without valves i.e. conventionally referred to as a valveless system and FIG. 6 illustrates such a system. In this modification of the above-embodiment, the valve assembly 15, 16 and 18 are replaced by upper and lower liner support members 101, 102. The compressed air is directed into the upper piston chamber and with piston 12 or 84 in striking position, the air is free to escape via outside piston liner exhaust parts 28. Compressed air is also allowed to pass down between outside piston liner 29 and barrel 30 as in above embodiment and between inside piston liner 103 and by-pass tube 5 to enter the lower piston chamber via inlet port holes 41 or 104. Both the number and relative position to each other of the inlet and outlet port holes differ in this alternative "valveless" means to the "valve" means previously described. Because of this, the compressed air which builds up in the lower piston chamber, begins to push piston 12 or 84 upwards and will continue to do so until exhaust ports 28 become closed. Momentum carries the piston 12 or 84 still further until the driving air in the lower piston chamber also begins to exhaust out via ports 28. At the moment the balance is altered and piston 12 or 84 begins to descend in its downstroke, pushed by air building up in the upper piston chamber. So the cycle repeats itself in rapid succession.

An alternative means for air to drive piston 12 or 84 in its upstroke is a valve chest top which directs air inwards via a plurality of holes to be channeled down between by pass tube 5 and an inside piston liner 103.

An alternative means for advancing or retarding performance of hammer without affecting sample tube flushing can be provided. The control grommets 14 and valve cap 13 are replaced by upper and lower valve controls 106, 107. A locking pin 108 holds both together and allows a plurality of holes in both valve controls 106, 107 to align with each other in various degrees.

Sample tube locating pins 109 positioned throughout at convenient points to keep the sample tube 6 central.

By pass tube stop ring 110 fixes the by pass tube 5 centrally and from axial movement.

Liner end plug 111 is attached to lower end of inside piston liner 103 by means of circlip 112 or similar and contains seal member 113.

Flushing jet 7 may be part of by pass tube 5 or attached by means of a circlip or similar fastening.

I claim:

1. Apparatus for drilling a bore hole comprising a hammer and a dual walled drill tube, said hammer being mounted to one end of said tube, said hammer comprising a hammer piston reciprocably coupled to said hammer, fluid flow control means for directing fluid under pressure to said hammer to reciprocably drive said piston, cutting means rotatably coupled to said hammer, said cutting means rotating upon reciprocation of said hammer to cut said bore hole, thereby forming particulate material in said bore hole, ratchet means operatively coupled to said cutting means for permitting rotation of said cutting means in one direction only and preventing rotation in an opposite direction, and means for diverting a portion of said fluid under pressure to entrain and direct said particulate material to the surface of the bore hole.

2. Apparatus as claimed in claim 1, further comprising an upstanding rig positioned at the surface of the bore hole for supporting said hammer and said drill tube.

3. Apparatus as claimed in claim 1, further comprising a sampling tube coaxially positioned with respect to said drill tube, wherein said means for diverting fluid under pressure comprises an annular flushing jet, said jet directing a portion of said fluid upwardly through said sampling tube, said hammer inducing a venturi to assist in conducting said particulate material entrained fluid upwardly.

4. Apparatus as claimed in claim 1, wherein said hammer comprises an automatic valve for controlling fluid flow and governing movement of said hammer position.

5. Apparatus as claimed in claim 4, wherein said automatic valve comprises a valve cap, a plurality of fluid control grommets, an automatic valve chest top, a flap valve and an automatic valve chest bottom.

6. Apparatus as claimed in claim 5, further comprising means for adjusting said plurality of grommets in said valve cap to modulate reciprocation of said hammer piston.

7. Apparatus as claimed in claim 3, whereby said cutting means comprises a drill bit shank and said flushing jet is sealed to said drill bit shank.

8. Apparatus as claimed in claim 1, wherein said fluid flow control means comprises an annular automatic valve operable by pressure changes occurring incident to said reciprocation of said hammer piston.

9. Apparatus as claimed in claim 3, wherein said hammer includes an automatic valve for controlling fluid flow and governing movement of said hammer piston.

10. Apparatus as claimed in claim 1, wherein said cutting means comprises a rotary bit, a portion of said bit extending into said hammer chamber for receiving periodic impacts from said reciprocable hammer piston.

11. Apparatus as claimed in claim 3, wherein said hammer chamber is of substantially annular cross-section and comprises an inner wall and an outer wall, a first annular passage extending through the walls of said dual-walled drill tube, a flushing tube being positioned within said chamber inner wall and defining a second annular passage in fluid communication with said first annular passage and said annular flushing jet.

12. Apparatus as claimed in claim 11, wherein said fluid flow control means comprises an annular automatic valve operable by pressure changes occurring incident to said reciprocation of said hammer piston.

13. Apparatus as claimed in claim 12, wherein said annular automatic valve comprises a first annular valve seat member and a second valve seat member spaced apart from said first valve seat member, each of said valve seat members comprising a port and defining between them an annular valve chamber connected to said first annular passage, said ports being connected by passageways to opposite ends of said hammer chamber, an annular valve element positioned within said valve chamber being freely movable under the influence of said pressure changes between first and second positions in which it blocks said ports in said first and second valve seat members, respectively.

14. Apparatus as claimed in claim 13, further comprising adjustable means associated with said first valve seat member for adjustably throttling the supply of fluid from said first annular passage to said annular valve chamber.

15. Apparatus as claimed in claim 13, wherein said transmission means comprises said hammer piston, said ratchet means being coupled to said piston to effect rotation of said piston in one direction, and resisting piston rotation in an opposite direction, upon reciprocable movement of said piston.

16. Apparatus as claimed in claim 1, further comprising transmission means and rotary drive means, said rotary drive means comprising a rotary drive member mounted in said hammer chamber and coupled to said hammer piston, said reciprocation of said hammer piston effecting rotation of said drive member, said transmission means transmitting said rotation of said drive member to said cutting means to effect rotation of said cutting means.

17. Apparatus as recited in claim 16, wherein said transmission means comprises an annular collar drivingly and axially slidably coupled to said rotary drive member and to said cutting means through said ratchet means.

18. Apparatus as recited in claim 17, further comprising means for preventing rotation of said piston.

* * * * *